United States Patent [19]

Künne

[11] 4,388,793

[45] Jun. 21, 1983

[54] APPARATUS FOR EMPTYING ENVELOPES

[75] Inventor: Wolfgang Künne, Rellingen, Fed. Rep. of Germany

[73] Assignee: Stielow GmbH, Norderstedt, Fed. Rep. of Germany

[21] Appl. No.: 242,145

[22] Filed: Mar. 9, 1981

[30] Foreign Application Priority Data

Apr. 2, 1980 [DE] Fed. Rep. of Germany ..... 3012857

[51] Int. Cl.[3] ..... B65B 43/30

[52] U.S. Cl. ..... 53/381 R; 53/569

[58] Field of Search ..... 53/573, 386, 381 R, 53/569, 570, 571

[56] References Cited

U.S. PATENT DOCUMENTS

| | | | |
|---|---|---|---|
| 3,566,578 | 6/1968 | Thorne | 53/573 |
| 3,739,543 | 6/1973 | Harris | 53/381 R |
| 4,123,890 | 11/1978 | Russell | 53/381 R |
| 4,156,334 | 5/1979 | Burgat | 53/386 |
| 4,159,611 | 7/1979 | Russell | 53/386 |

FOREIGN PATENT DOCUMENTS

| | | | |
|---|---|---|---|
| 2068906 | 8/1981 | United Kingdom | 53/386 |

*Primary Examiner*—Nicholas P. Godici
*Assistant Examiner*—Kurt Rowan
*Attorney, Agent, or Firm*—Staas & Halsey

[57] ABSTRACT

An apparatus for removing the content from envelopes having two adjacent edges opened by slitting or cutting is equipped with two facing suction devices. At least one suction device is movable perpendicular to the envelope plane for separating the envelope. During the operating phase, one suction device is movable with respect to the other in the envelope plane in order to effect a relative movement between the envelope and the contents of the envelope. This facilitates removal because the envelope held by the suction device is additionally deformed, i.e., given a corrugated configuration by the movement in the envelope plane. As a result, easy removal of the envelope content is possible.

6 Claims, 4 Drawing Figures

APPARATUS FOR EMPTYING ENVELOPES

BACKGROUND OF THE INVENTION

The invention relates to an apparatus for emptying envelopes having at least two adjacent opened edges by means of facing suction devices, wherein at least one suction device is movable perpendicular to the envelope plane for separating the sides of the envelope.

In a known apparatus of the aforementioned type, the envelopes opened along one longitudinal edge are separated by two facing suction devices. To this end, at least one of the suction devices is movable perpendicular to the envelope plane. After separation, it is fundamentally possible to remove the envelope content. This removal can, for example, be made more difficult by the fact that the sheet of notepaper engages on one of the inner sides of the envelope or is also sucked up by one of the suction devices, the latter being particularly a problem with thin envelopes. Automatic removal of the contents of envelopes by means of a mechanical device is not possible with the known apparatus. See German Offenlegungsschrift No. 2,543,692.

In addition, an apparatus for processing envelopes is known having two facing suction devices for opening the envelope which is only slitted along one edge. One of the suction devices can be moved in the envelope plane relative to the other. This additional movement in the envelope plane takes place in the stationary state to permit adaptation to the envelope size and not when an envelope is located between the suction devices. The corresponding suction device is always moved as close as possible to the slit edge. See German Offenlegungsschrift No. 2,732,936.

BRIEF SUMMARY OF THE INVENTION

The above problems are solved by the apparatus according to the invention, wherein one suction device is additionally movable in the envelope plane with respect to the other suction device during the envelope opening operating phase.

According to the invention, the two suction devices are not only movable perpendicular to the envelope plane for separating the open envelope sides, but in addition one suction device is movable in the envelope plane to carry out the relative movement between envelope and envelope content. This facilitates removal, because the envelope held by the suction device is additionally deformed, i.e., corrugated by the movement in the envelope plane, so that the non-corrugated sheet of notepaper can easily be removed. If, in advantageous manner, the envelope is opened by cutting or slitting along two adjacent edges, the sheet of paper is lifted out by the movement relative to the envelope at one slit edge, so that once again removal is facilitated. As a result of the removal preparation according to the invention, it is also possible to bring about an automatic mechanical removal by a gripping device or the like by effecting a definite separation of the sheets of paper from the envelope. Furthermore, the relative movement between the envelope and paper detaches from the corresponding envelope side any paper which may have been sucked up in the case of thin envelopes. Advantageously, the suction devices are arranged in a displaced manner in the envelope plane. This ensures that with thin and correspondingly air-permeable letters, the devices are not sucked against one another, which could prevent separation.

In the case of suction devices staggered in the envelope plane, it is finally also possible to provide on the suction device movable perpendicular to the envelope plane an envelope holding or backing member for the other suction device. This ensures that the envelope already opened by slitting or cutting and transported in the vicinity of the first suction device is also reliably sucked in, because the holding member presses the envelope against the other suction device.

Advantageously, the apparatus can also be provided with a light source which fully illuminates the open envelope with preferably concentrated light. This ensures a deliberate grasping on removal and a visual examination, so that it can be established that the complete envelope content is removed.

BRIEF DESCRIPTION OF THE DRAWINGS

The invention is described in greater detail hereinafter relative to non-limitative embodiments and with reference to the drawings.

DETAILED DESCRIPTION OF THE PREFERRED EMBODIMENTS

Figure 1:
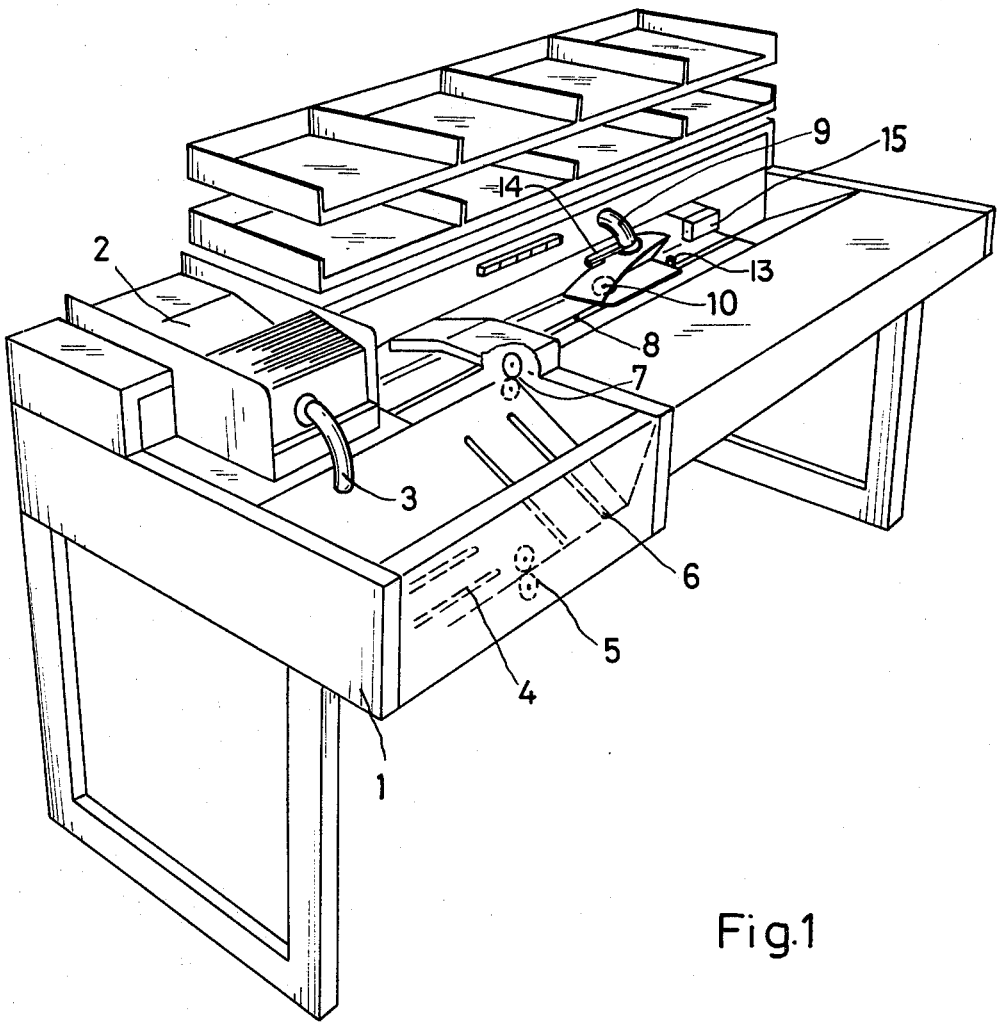
FIG. 1 is a perspective view of an embodiment with two cutting mechanisms for the apparatus according to the invention.
Figure 2:
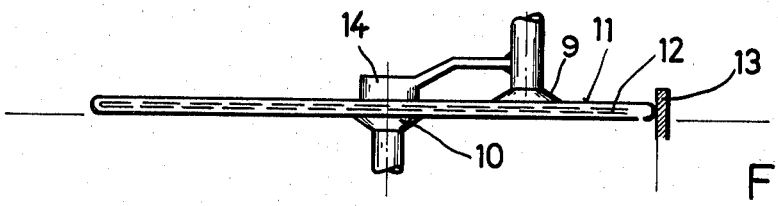
FIG. 2 is a diagrammatic side view of an envelope to be emptied prior to the relative movement of the suction devices perpendicular to the envelope plane.
Figure 3:
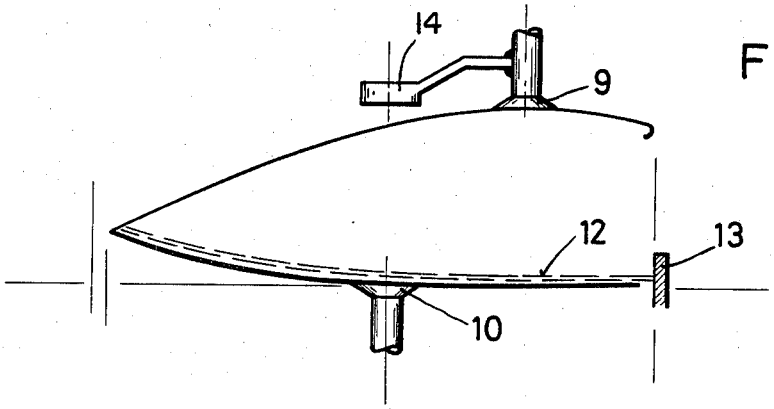
FIG. 3 is a view corresponding to FIG. 2, but after performing the movement of a suction device perpendicular to the envelope plane.
Figure 4:
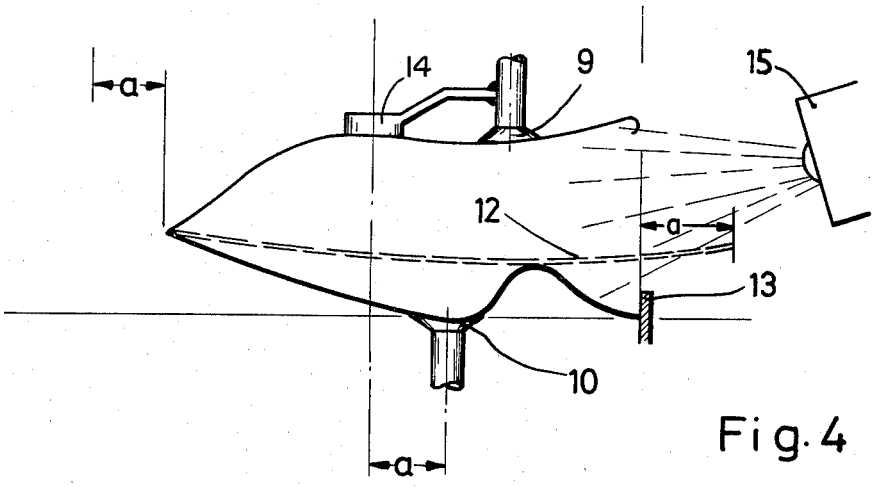
FIG. 4 is a view corresponding to FIGS. 2 and 3, but after carrying out the additional movement of a suction device in the envelope plane in the direction of an open edge.

The apparatus shown in FIG. 1, which can also be called a post receiving or letter removing station, is placed in a frame 1. The envelopes are individually placed on a conveyor from a magazine 2 by means of a suction device 3 and one edge thereof is slit at 5. They are then conveyed by device 6 onto a second conveyor 8 and at 8 the adjacent edge is slit. Conveyor 8 then conveys the envelope 7 slit in this way along two edges into the vicinity of suction devices 9 and 10 which, as can be seen from FIGS. 2 to 4, are arranged in a staggered manner in the envelope plane. Furthermore, in the vicinity of conveyor 8 there is a stop member 13 for engaging one edge of the envelope.

An envelope holding or backing member 14 for the other suction device 10 is provided on suction device 9, which is pivotable perpendicular to the envelope plane.

If an envelope to be emptied reaches the vicinity of suction devices 9 and 10 and takes up the position shown in FIG. 2 fixed by stop member 13, the suction device 9 is pivoted onto the envelope. This leads to engagement of suction device 9 with the envelope side which faces it. Holding member 14 presses the other envelope side against the other suction device 10. Suction devices 9 and 10 now perform the sucking in operation. Suction device 9 is swung back, so that envelope 11 and envelope content, such as a sheet of paper 12, assume the form shown in FIG. 3. The other suction device 10 is now moved in the envelope plane by distance a in the direction of the envelope open edge, i.e, in the direction of stop member 13. As a result, the suction devices 9 and 10 and holding member 14 assume the positions illustrated in FIG. 4.

It is obvious that the envelope sides have an increased deformation or corrugated form, which permits the easy removal of the sheet of paper 12. It is also clear that the left-hand closed envelope edge is moved upwards and to the right approximately by the same amount as the distance "a" moved by suction device 10. The sheet of paper 12 is moved out of the opposing open envelope edge by the corresponding amount, which also facilitates removal. It is also possible to bring about an automatic removal by a gripping device (not shown).

If the sheet of paper 12 assumes the position shown in FIG. 3, it ultimately assumes the position shown in FIG. 4 because there is a relative movement in the envelope plane between the envelope and the paper.

Due to the staggering of the two suction devices 9 and 10 in the envelope plane, they cannot stick against one another in the case of thin envelopes and consequently prevent opening of the envelope. Holding member 14 ensures that the minimum quantity of secondary air is sucked in during the operation of suction device 10.

The sheets of paper removed are appropriately sorted into the pigeon holes of the apparatus shown in FIG. 1.

The drawings, particularly FIG. 1, show two cutting mechanisms 5 and 7. However, within the scope of the invention, it is also possible to provide a third cutting mechanism on the side facing cutting mechanism 7 in order to permit slitting of the third edge of the envelope. In this embodiment with three cutting mechanisms, firstly the envelope edge is cut by the cutting mechanism not shown in FIG. 1. Thereafter, the operating procedure is the same as that described in conjunction with FIG. 1. The desired corrugated form is also obtained when opening along three edges.

A light source 15 which illuminates the open envelope is also provided as shown in FIGS. 1 and 4.

What is claimed is:

1. An apparatus for emptying the contents of envelopes having at least two adjacent opened edges comprising: a pair of suction devices positioned for facing and holding opposite sides of an envelope to be emptied, wherein one suction device for holding one envelope side is movable perpendicular to the envelope plane for separating the sides of the envelope and wherein the other suction device for holding the opposite envelope side is movable along the envelope plane for providing relative movement between the envelope and envelope contents as the suction device movable perpendicular to the envelope plane separates the sides of the envelope.

2. An apparatus according to claim 1, wherein the suction devices are staggered along the envelope plane.

3. An apparatus according to claim 2, further comprising an envelope backing member for the section device movable along the envelope plane, said backing member being connected to the suction device movable perpendicular to the envelope plane.

4. An apparatus according to claim 1, further comprising a light source for illuminating the inside of the opened envelope.

5. An apparatus according to claim 1, 2, or 3, further comprising means positioned for cutting or slitting at least two adjacent edges of an envelope to be emptied prior to receipt of the envelope between the pair of suction devices.

6. An apparatus according to claim 5, further comprising stop means for engaging one of the open envelope edges and positioning an envelope between the suction devices.

* * * * *